US005188225A

United States Patent [19]

Jorba

[11] Patent Number: 5,188,225

[45] Date of Patent: Feb. 23, 1993

[54] CARRIER FOR A GROUP OF CONTAINERS AND CARDBOARD BLANK THEREFOR

[76] Inventor: José Jorba, Rubio, 10, Igualada (Barcelona), Spain, 08700

[21] Appl. No.: 915,397

[22] Filed: Jul. 20, 1992

Related U.S. Application Data

[63] Continuation of Ser. No. 673,061, Mar. 22, 1991, abandoned.

[30] Foreign Application Priority Data

Mar. 22, 1990 [ES] Spain ..... 9000836

[51] Int. Cl.[5] ..... B65D 75/00

[52] U.S. Cl. ..... 206/145; 206/148; 206/149; 206/158; 206/161

[58] Field of Search ..... 206/139, 141, 145, 147, 206/148, 149, 150, 151, 152, 153, 155, 156, 158, 161, 427, 429, 434

[56] References Cited

U.S. PATENT DOCUMENTS

| | | | |
|---|---|---|---|
| 2,472,005 | 5/1949 | De Swart . | |
| 2,834,461 | 5/1958 | Dusseault | 206/158 |
| 2,844,245 | 7/1958 | Gruber et al. . | |
| 3,038,600 | 6/1962 | Powell | 206/158 |
| 3,099,475 | 7/1963 | Manizza | 206/153 X |
| 3,310,334 | 3/1967 | Murphy | 206/145 X |
| 3,404,912 | 10/1968 | Watts . | |
| 3,414,313 | 12/1968 | Schwarz | 206/156 X |
| 3,653,503 | 4/1972 | Arneson | 206/153 |
| 3,687,281 | 8/1972 | Prot . | |
| 3,698,550 | 10/1972 | Graser . | |
| 3,764,001 | 10/1973 | Graser | 206/148 |
| 4,192,540 | 3/1980 | Oliff | 206/161 X |
| 4,273,273 | 6/1981 | Zenri . | |
| 4,305,499 | 12/1981 | Mercer | 206/150 |
| 4,453,630 | 6/1984 | Helms et al. | 206/147 X |
| 4,596,356 | 6/1986 | Chaussadas . | |
| 5,022,525 | 6/1991 | Schuster | 206/158 X |

FOREIGN PATENT DOCUMENTS

| | | |
|---|---|---|
| 686614 | 5/1964 | Canada . |
| 112647 | 12/1968 | Denmark . |
| 3711322 | 5/1988 | Fed. Rep. of Germany . |
| 2098585 | 3/1972 | France . |
| 2547796 | 12/1984 | France . |

*Primary Examiner*—Paul T. Sewell
*Assistant Examiner*—Jacob K. Ackun, Jr.
*Attorney, Agent, or Firm*—Wenderoth, Lind & Poncak

[57] ABSTRACT

The carrier is provided with retention openings formed by two kinds of radial flanges of special shapes. The carriers are preferably made of cardboard or pasteboard diecast blanks which are introduced over the top of the containers and which by and adhesion form the carriers. The invention has application in the support and transport of containers in groups of one or more rows, especially soft drink cans or pots.

14 Claims, 1 Drawing Sheet

CARRIER FOR A GROUP OF CONTAINERS AND CARDBOARD BLANK THEREFOR

This application is a continuation of now abandoned application, Ser. No. 07/673,061, filed Mar. 22, 1991 and now abandoned.

The invention is related to application Ser. No. 07/459,424 filed Dec. 29, 1989.

The invention pertains to an improved provision of container retaining openings in the carrier or in the cardboard blanks thereof.

In accordance with the state of the art, this type of carriers are formed from blanks in cardboard or plastic, in which openings are executed provided with flanges or radial projections for retention of the containers to be supported, as for example the article carriers described in U.S. Pat. Nos. 3,038,600, 3,404,912 and 3,432,202.

The blanks are laid down over the top of the containers and then pushed down until the radial flanges or projections of the retaining openings snap under the rim, chime or bead of the containers. Said snapping action is expedited by favouring the displacement as a hinge of the flanges or projections.

In application Ser. No. 07/459,424 has been proposed the presence of small spaced cuts over the circular marking lines of the retention openings, in order to ease the lifting or hinge of the flanges. However, it has been observed that said displacement of the flanges is still improved when cut-outs are made in the tangential contact zones between retention openings. Preferably said cut-outs adopt an elliptical shape.

Also it has been observed that the performance of the retention openings is improved when two kinds of radial flanges or projections are provided therein. Particularly groups of first straight flanges in variable number placed diametrically opposite inside the retention openings and a pair of second flanges placed between said groups. The second flanges adopting a shape similar to a circular segment of concave chord.

Therefore, it is a first objective of the invention to provide a carrier for a group of containers and the cardboard blank therefor, in which the retention openings for the containers are provided with two kinds of retention flanges and the tangential contact zone between retention openings presents cut-outs.

In a basic form of execution, a carrier for a group of containers according to the invention:

is made of cardboard or pasteboard, and comprises a lower surface for retention of containers, in which by diecasting and marking there have been determined series of two or more retention openings for the containers, axially aligned and in tangential contact, an upper surface for covering the caps of the containers, which is smooth and of a substantially rectangular shape in plant, the contour of said retention openings being circular, with a diameter coinciding with or slightly longer than the one of the tops of the containers to be retained by first flanges for retention of containers projecting radially in variable number toward the inside of said retention openings, located in a position diametrically opposite to other group of flanges substantially equal, and second unitary flanges for retention of containers, located between the groups of first ones, which adopt a shape approximately of a circular segment of concave chord.

In a preferable form of execution, U-shaped cuts are provided in the separation between the first and second retention flanges.

In another form of execution, a carrier according to the invention:

is made of cardboard or pasteboard, and comprises a lower surface for retention of containers in which, by diecasting and marking, two rows of two or more equal retention openings for containers have been determined, each row being in axial alignment and with its retention openings in tangential contact, holding means occupying the spaces between the retention openings of the two rows, each one of said retention openings having a circular contour, of a diameter equal or slightly loner than the one of the tops of the container, first flanges for retention of containers projecting radially in variable number toward the inside of said retention openings, which are placed in a position diametrically opposite to other group of substantially equal flanges, second unitary flanges for retention of containers, located between the groups of first retention flanges, which adopt a shape approximately of a circular segment of concave chord, U-shaped cuts being provided in the separation between the first and the second retention flanges, and an upper surface for cohering the tops of the containers, which is smooth and substantially rectangular in plant, and which has in its central zone holding means coinciding in position and dimension wet those of the lower surface for retention of containers.

In a preferable form of execution, the holding means are two or more aligned finger holes.

In a preferable form of execution, the tangential contact zone between retention openings comprises a cut-out portion which also preferably adopts an elliptical shape in plant.

In any of the foregoing executions, the carriers of the invention are manufactured from cardboard or pasteboard blanks, also being an objective of the invention, in which the retention openings show the characteristics and configurations above defined for the carrier, and which are joined by means of the corresponding flaps or parts which, by folding or bending and subsequent gluing, stapling or the like, produce formation of the carriers of the invention.

A better understanding of the improvements provided by the invention will be obtained from the detailed description which follows of a form of practical execution, illustrated without a limiting nature in the attached page of drawings, in which.

Figure 1:
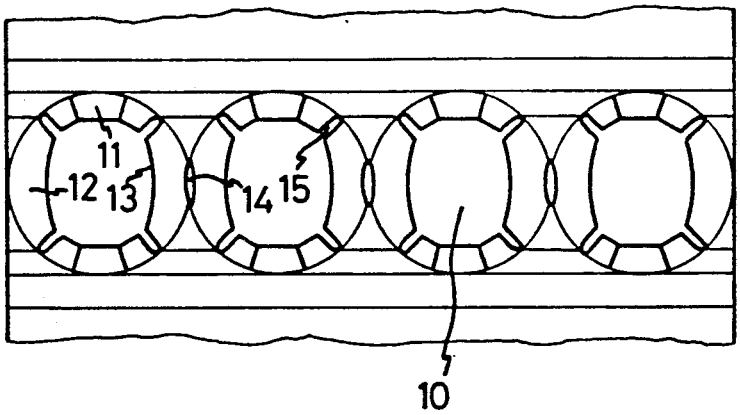
FIG. 1 is a partial plan view illustrating an example of execution of the retention openings for containers according to the invention.

In FIG. 1 an example is illustrated of a portion of cardboard or pasteboard blank for executing a carrier for containers according to the invention, which shows a series of equal retention openings (10) (four in the example), axially aligned, of circular contour and in tangential contact, each one constituted by the regular or diametrically opposite alternation between two groups of first retention flanges (11) and a pair of second unitary retention flanges (12) approximately in the form of a circular segment of chord (13) arched concavely.

The containers may be of a large variety of types, but those having a frustoconical shape or a shoulder in their top forming with their rim, chime or bead a perimetral notch or groove will be preferred. An example are the cans (40) partially illustrated in FIG. 3, although other containers may be suitable, including those in which their upper parts form the said perimetral notch or groove in the proximity of their caps.

Figure 2:
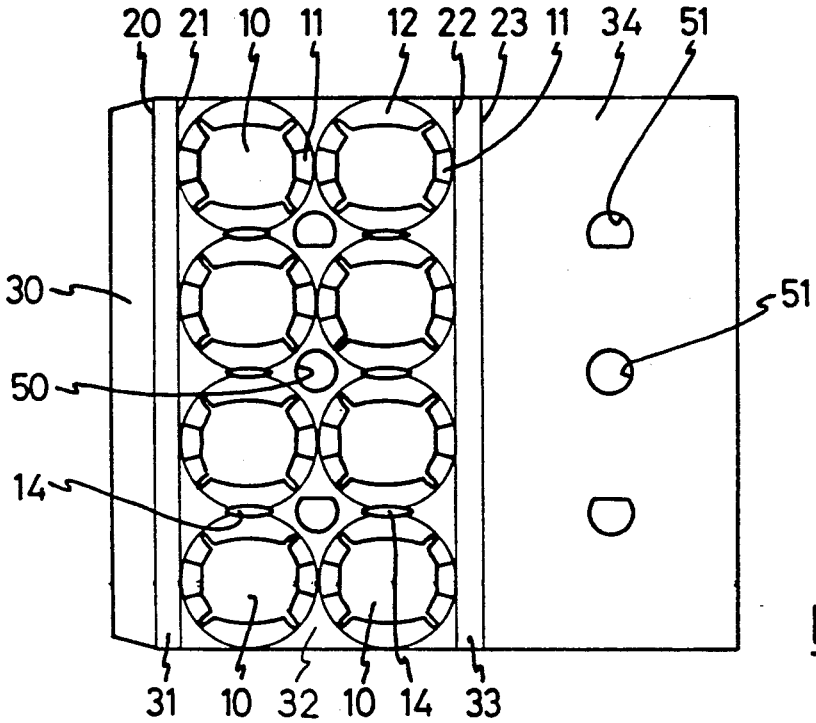
FIG. 2 is a plan view of an example of a blank forming a carrier according to the invention.

In FIG. 2 it is illustrated an example of a diecast blank, of cardboard or pasteboard, to execute a carrier for containers according to the invention, designed to support eight containers (40) in two parallel rows. As represented, the blank adopts a substantially rectangular plant, in which two main surfaces or flaps (32,34) have been determined by lines of marking and folding (20,21,22,23). By folding and superposition, as can be deducted from FIG. 3, and union by means of adhesive or other means, the formation of a carrier with an upper smooth surface (34) and a lower surface (32) provided with retention openings (10) is achieved.

The surface or flap (32) of the blank presents two rows of four equal retention openings (10) axially aligned, of circular contour and in tangential contact, each one constituted by the regular or diametrically opposite alternation between groups of first retention flanges (11) and a pair of second unitary flanges (12). Preferably, each one of the points or zones of union or transition between flanges (11) and (12) will present a small space or U-cut (15) the scope of which is to improve the adaptation of the retention flanges (11,12) to the top of the containers, in particular under the rim, chime or bead (41) which they used to be provided (FIG. 3).

Figure 3:
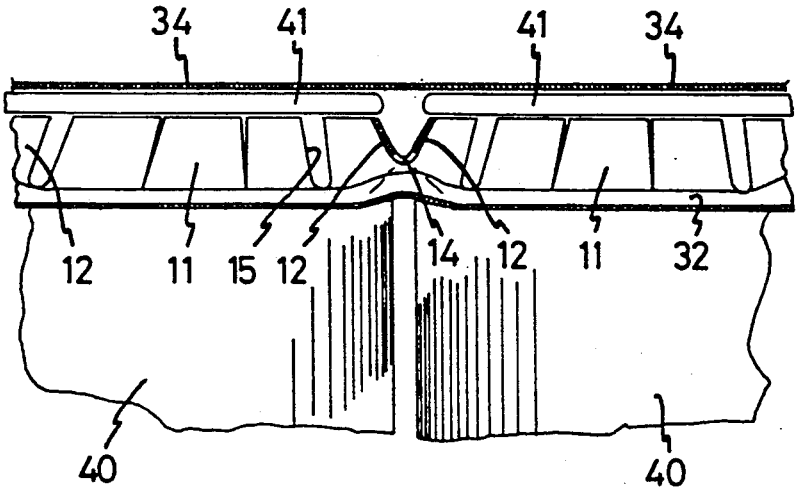
FIG. 3 is an enlarged view in partial section illustrating the arrangement between elements of a carrier formed from the blank illustrated in FIG. 2.

At each side of the flap surface (32) provided with retention openings (10), by means of spaced pairs of folding lines (20,21) and (22,23), two narrow rigidizing flaps (31,33) are formed, which when folded to form the carrier according to FIG. 3, constitute ribs through the lines (20,21,22,23) which work as rigidizing or resistance agents to the strains which the carrier experience when holded.

For supporting and handling the carriers holding means have been provided in the form of holes (50) and (51) in respective flaps (32) and (34) which will coincide when the latter is brought down over the first one. Said holes (50,51) will have a size in accordance with the fingers of an adult's hand.

The diameter of the top of the containers (40) should coincide with or be slightly less than the one of the contour of the retention openings of the surface (32) of the blank, which when it is superimposed and pushed toward the base of the containers until the edge or chord (13) of the flanges (12), snaps into the cited perimetral notch or groove of the top of the containers (40). Then the flaps (30,34) are folded and joined, as indicated previously, and the support carrier of the invention is formed with its upper smooth surface (34) and the lower surface of retention (32) as represented in FIG. 3.

By the preceding description, it is deduced that the union between the carrier and containers (40) depends on the flexion or ease of lifting of the flanges (11,12) along the retention openings (10). The material used, cardboard or pasteboard, generally has enough flexibility to allow the displacement of the retention flanges (11,12) during their introduction over the top of the containers (40). However, said displacement can be facilitated when the tangential contact zones between retention openings (10) in their respective row, present a hole or cut-out (14) with a shape approximately to an ellipse, which eases the hinging or lifting of the retention flanges (12) until snapping in the rim, chime or bead (41) of the containers (40).

In the figures, and as can be understood it is also illustrated that a carrier according to the invention might support different groups of containers (40) depending on the number of retention openings with which it is equipped.

I claim:

1. A carrier for supporting a group of containers, said carrier comprising:

a lower panel for retention of containers, said lower panel defining at least one row of a plurality of circular retention openings, the peripheries of said circular retention openings being located tangentially with respect to one another in each said row;

respective groups of first flanges extending radially inwardly from the periphery of each of the circular retention openings, said respective groups of first flanges being located diametrically opposite one another with respect to the circular retention opening, and each of said flanges having a free end terminating at an edge;

a pair of second unitary flanges extending radially inwardly from the periphery of each of the circular retention openings, each of said second unitary flanges being interposed between said respective groups of said first flanges in the circumferential direction of the circular retention opening, each of said second unitary flanges having a free end terminating at a concave edge approximately in the shape of a circular arc when lying flat in the same plane as the circular retention opening, and each of said second unitary flanges having a length as taken along the edge at said free end thereof that is greater than that of each of said first flanges for each of said openings;

said lower panel having recesses therein extending into respective ones of said second unitary flanges at location where said second unitary flanges would otherwise extend radially inwardly from the periphery of each of the circular retention openings, thereby facilitating the lifting of said respective ones of said second unitary flanges as hinges about the periphery of the circular retention opening; and a flat upper panel connected to said lower panel and spaced therefrom over said circular retention openings so as to cover tops of containers when retained in the openings, said upper panel having a substantially rectangular shape in plan.

2. A carrier for supporting a group of containers as claimed in claim 1, wherein the lower panel defines two rows of said circular retention opening, the peripheries of said circular openings being located tangentially with respect to one another in each said row, wherein said lower panel has at least two finger holes therethrough located between said two rows of circular retention openings, and said upper panel has at least two finger holes therethrough aligned with the finger holes in said lower panel, respectively.

3. A carrier for supporting a group of containers as claimed in claim 1, wherein a U-shaped space exists between each of said respective groups of said first retention flanges and each of said second unitary flanges in each of said circular retention openings when each of said flanges are lying flat in the same plane as the circular retention opening, whereby displacement of said flanges in the same direction out of said plane about the periphery of the circular retention opening is facilitated.

4. A carrier for supporting a group of containers as claimed in claim 1, wherein said recesses extending in the lower panel are located where said circular retention opening are tangential to one another such that each of the recesses extends into opposing ones of said second unitary flanges that extend radially inwardly from the periphery of adjacent ones of the circular retention openings.

5. A carrier for supporting a group of containers as claimed in claim 1, wherein each said respective recess is elliptical.

6. A blank for forming a carrier for supporting a group of containers, said blank comprising a flat sheet of cardboard or pasteboard having fold lines extending thereacross and dividing the sheet into at least two panels, one of said panels defining at least one row of a plurality of circular retention openings, the peripheries of said circular retention openings being located tangentially with respect to one another in each said row; respective groups of first flanges extending into each of said circular retention openings from the periphery of the circular retention opening, said respective groups of first flanges being located diametrically opposite one another with respect to the circular retention opening, and each of said flanges having a free end terminating at an edge; a pair of second unitary flanges extending into each of said circular retention openings from the periphery of the circular retention opening, each of said second unitary flanges being interposed between said respective groups of said first flanges in the circumferential direction of said circular retention opening, each of said second unitary flanges having a free end terminating at a concave edge approximately in the shape of a circular arc when lying flat in the same plane as the circular retention opening, and each of said second unitary flanges having a length as taken along the edge at said free end thereof that is greater than that of each of said first flanges for each of said openings; said lower panel having recesses therein extending into respective one of said second unitary flanges at locations where said second unitary flanges would otherwise extend radially inwardly from the periphery of each of the circular retention openings, thereby facilitating the lifting of said respective ones of said second unitary flanges as hinges about the periphery of the circular retention openings; and the other of said panels having a rectangular shape.

7. A blank for forming a carrier for supporting a group of containers as claimed in claim 6, wherein said one of said panels defines two rows of said circular retention openings, the peripheries of said circular openings being located tangentially with respect to one another in each said row, wherein said one of said panels has at least two finger holes therethrough located between said two rows of circular retention openings, and said the other of said panels has at least two finger holes therethrough aligned with the finger holes in said one of said panels, respectively.

8. A blank for forming a carrier for supporting a group of containers as claimed in claim 6, wherein a U-shaped space exists between each of said respective groups of said first retention flanges and each of said second unitary flanges in each of said circular retention openings whereby displacement of said flanges in the same direction about the periphery of the circular retention opening is facilitated.

9. A blank for forming a carrier for supporting a group of containers as claimed in claim 6, wherein said recesses extending in said one of said panels are located where said circular retention openings are tangential to one another such that each of the recesses extends into opposing ones of said second unitary flanges that extend radially inwardly from the periphery of adjacent ones of the circular retention openings.

10. A blank for forming a carrier for supporting a group of containers as claimed in claim 9, wherein each said respective recess is elliptical.

11. The combination of a group of containers and a carrier supporting the containers, said containers each having a top defining a notch or groove therein extending around the periphery of the container; and said carrier including a lower panel defining at least one row of circular retention openings, the peripheries of said circular retention openings being located tangentially with respect to one another in each said row, the tops of said containers extending through said circular retention openings, respectively, respective groups of first flanges extending at an inclination relative to said lower panel from the periphery of each of said circular retention openings, said respective groups of first flanges being located dismetrically opposite one another with respect to the circular retention opening, and each of said first flanges having a free end terminating at an edge within the peripheral notch or groove defined in the top of a respective one of the containers which extends through the circular retention opening, a pair of second unitary flanges extending at an inclination relative to said lower panel from the periphery of each of said circular retention openings, each of said second unitary flanges being interposed between said respective groups of said first flanges in the circumferential direction of said circular retention opening, each of said second unitary flanges having a free end terminating at an edge engaging the container within the peripheral notch or groove defined in the top of a respective one of the containers which extends through the circular retention opening, said lower panel having recesses therein extending into respective ones of said second unitary flanges at location where said second unitary flanges would otherwise extend radially inwardly from the periphery of each of the circular retention openings, thereby facilitating the lifting of said respective ones of said second unitary flanges as hinges about the periphery of the circular retention openings; and a flat upper panel connected to said lower panel and spaced therefrom over said circular retention openings so as to cover the tops of said containers, said upper panel having a substantially rectangular shape in plan.

12. The combination of a group of containers and a carrier supporting the containers as claimed in claim 11, wherein said lower panel defines two rows of said circular retention openings, the peripheries of said circular openings being located tangentially with respect to one another in each said row, wherein said lower panel has at least two finger holes therethrough located between said two rows of circular retention openings, and said upper panel has at least two finger holes therethrough aligned with the finger holes in said lower panel, respectively.

13. The combination of a group of containers and a carrier supporting the container as claimed in claim 11, wherein said recesses extending in said lower panel are located where said circular retention openings are tangential to one another such that each of the recesses extends into opposing ones of said second unitary flanges that extend radially inwardly from the periphery of adjacent ones of the circular retention openings.

14. The combination of a group of containers and a carrier supporting the containers as claimed in claim 13, wherein each said respective recess is elliptical.

* * * * *